US005588376A

United States Patent [19]

Seidl et al.

[11] Patent Number: 5,588,376

[45] Date of Patent: Dec. 31, 1996

[54] SYSTEM FOR MOUNTING ONE OR MORE ITEMS TO THE LEG STRUCTURE OF A WORKTABLE

[75] Inventors: Lon D. Seidl; David R. Funk, both of Green Bay, Wis.

[73] Assignee: Krueger International, Green Bay, Wis.

[21] Appl. No.: 201,465

[22] Filed: Feb. 24, 1994

[51] Int. Cl.[6] ..... A47B 9/00

[52] U.S. Cl. ..... 108/106; 108/50; 108/152; 312/196

[58] Field of Search ..... 108/152, 50, 144, 108/59, 93, 26, 106; 312/194, 195, 196

[56] References Cited

U.S. PATENT DOCUMENTS

| | | | |
|---|---|---|---|
| 3,469,711 | 9/1969 | Swaneck et al. . | |
| 4,040,588 | 8/1977 | Papsco et al. . | |
| 4,070,075 | 1/1978 | Morgan | 108/50 X |
| 4,116,509 | 9/1978 | Smith . | |
| 4,122,955 | 10/1978 | Celms . | |
| 4,311,101 | 1/1982 | de Almagro . | |
| 4,312,086 | 1/1982 | Bianco . | |
| 4,408,812 | 10/1983 | Krautwurst . | |
| 4,679,510 | 7/1987 | Veyhl et al. | 108/152 |
| 4,735,152 | 4/1988 | Bricker | 108/152 X |
| 4,751,884 | 6/1988 | Ball | 108/144 |
| 4,785,742 | 11/1988 | Esslinger . | |
| 4,852,500 | 8/1989 | Ryburg et al. | 108/50 X |
| 5,094,174 | 3/1992 | Grund et al. | 108/50 |
| 5,104,080 | 4/1992 | Berger | 108/152 X |
| 5,357,874 | 10/1994 | Palmer | 108/50 |

*Primary Examiner*—Jose V. Chen

*Attorney, Agent, or Firm*—Andrus, Sceales, Starke & Sawall

[57] ABSTRACT

A system for removably and adjustably mounting one or more items to the leg of a worktable includes vertical slot structure formed in the worktable leg and one or more bracket members mounted to the item to be mounted to the leg. Preferably, a pair of spaced slot patterns are formed in both the inner and outer surfaces of the worktable leg, and a pair of bracket members are mounted to each item which is to be mounted to the worktable leg. The brackets are removably engageable with the slot patterns, enabling the item to be moved to varying positions relative to the worktable leg. The brackets may be mounted to any number of items for securing such items to the worktable leg, such as a work surface extension, a file cabinet, a holder for a computer unit, and/or an overhead storage unit. As many items as desired can be mounted to the worktable leg in order to minimize the footprint of a work space and to efficiently arrange the items contained within the work space.

2 Claims, 4 Drawing Sheets

SYSTEM FOR MOUNTING ONE OR MORE ITEMS TO THE LEG STRUCTURE OF A WORKTABLE

BACKGROUND AND SUMMARY OF THE INVENTION

This invention relates to a worktable, and more particularly to an arrangement for mounting one or more auxiliary items to a worktable.

Typically, a worktable includes a tabletop supported by a pair of leg assemblies. Often, various storage and other components are used in the same general area as a worktable. Such components may include file cabinets and other storage units and other tables or work surfaces. Often, a worktable is used to support a computer monitor and keyboard, and the computer unit is stored below the worktable. Typically, a stand is used to support the computer unit off the floor.

It is an object of the present invention to provide a system for mounting one or more items to a worktable, utilizing the legs of the worktable to support the items. Another object of the invention is to provide a simple and efficient arrangement for mounting a variety of items to the worktable legs for providing an efficient work arrangement and reducing the overall footprint of a work area. Yet another object of the invention is to provide a mounting system which is easily adaptable to the conventional structure of a worktable leg.

The worktable in connection with which the invention is used includes one or more work surfaces supported above a pair of spaced legs, with each leg including a first inner surface facing toward the other leg and a second outer surface facing away from the other leg. In accordance with the invention, a system for mounting an item to the worktable includes one or more spaced vertical slot patterns provided on the leg, and one or more bracket members mounted to the item which is to be mounted to the worktable. The bracket member includes structure engageable with the slot pattern in the leg for removably mounting the item to the worktable leg. Preferably, a pair of spaced vertical slot patterns are provided on both the inner and outer surfaces of each leg, and a pair of bracket members are mounted to the item which is to be mounted to the worktable. The bracket members are spaced apart a distance substantially equal to the spacing of the slot patterns.

The invention is adapted to mount any desired item to the worktable leg. Representatively, such items may include a work surface extension, a file cabinet or pedestal, a holder for a computer unit, or an overhead storage unit. In each case, brackets are mounted to the item, and are removably engageable with the slot patterns for removably mounting the item to the worktable leg. With this construction, items can be mounted to both the inner and outer surfaces of each leg to fully utilize the mounting capacity of the leg and to provide a compact and efficient work area.

The invention also contemplates a method of removably mounting one or more items to one or more of the worktable legs, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
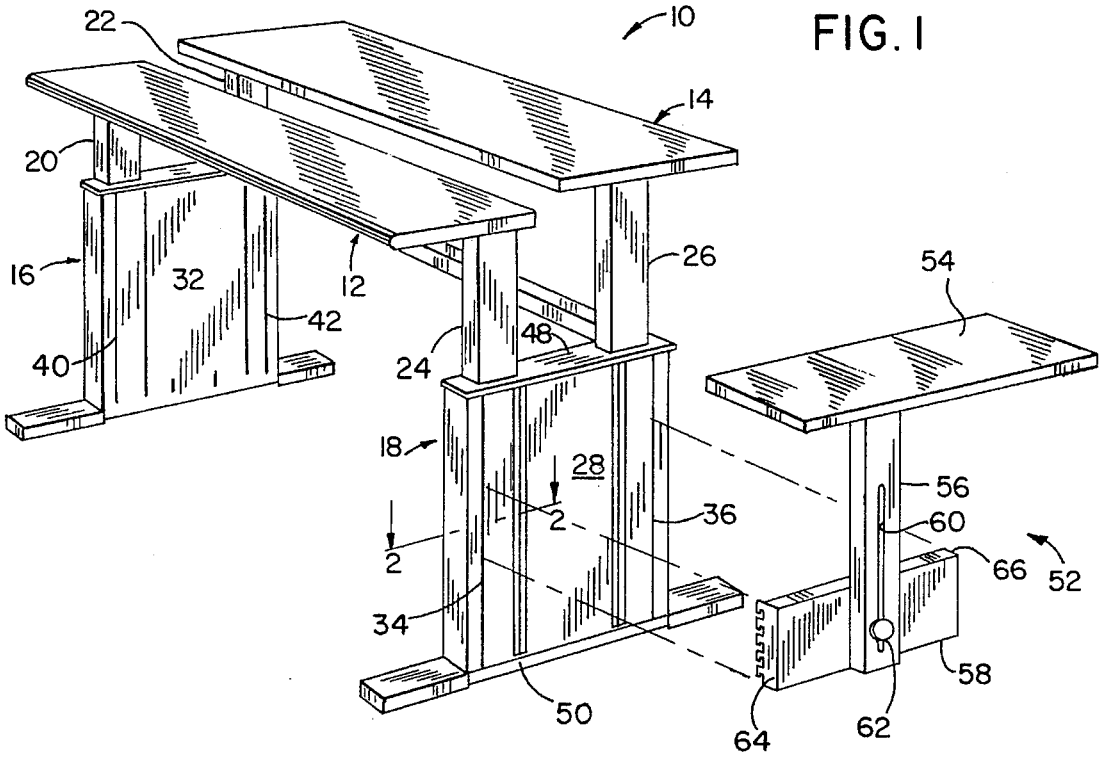
FIG. 1 is an isometric view of a worktable showing a work surface extension adapted for mounting to the outer surface of one of the worktable legs.

Referring to FIG. 1, a split-surface worktable 10 generally includes a front surface 12, a rear surface 14, and a pair of leg assemblies 16, 18. Leg assembly 16 includes a front leg 20 and a rear leg 22, and leg assembly 18 includes a front leg 24 and a rear leg 26. Front legs 20, 24 support front surface 12, and rear legs 22, 24 support rear surface 14. Leg assemblies 16, 18 also include an adjustable height mechanism interconnected with each of its respective front and rear legs for providing adjustability in the elevation of front surface 12 and rear surface 14 relative to the floor.

The components and assembly described above are generally known in the art, and are commercially available from Krueger International, Inc. of Green Bay, Wis., the assignee of the present application, under its designation WorkZone and/or DataBord.

Leg assembly 18 includes an outer surface or wall 28 which faces away from leg assembly 16, and an inner surface or wall 30 (FIG. 2) which faces toward leg assembly 16. Similarly, leg assembly 16 includes an inner surface or wall 32 facing leg assembly 18, and an outer surface or wall (not shown) facing away from leg assembly 18 and constructed similarly to outer surface 28 of leg assembly 18.

In accordance with the invention, a pair of vertical slot patterns, shown generally at 34, 36, are formed in outer surface 28 of leg assembly 18. A similar pair of slot patterns, one of which is shown at 38 (FIG. 2) are formed in inner surface 30 of leg assembly 18. Likewise, similar slot patterns are formed in the inner and outer surfaces of leg assembly 16. The slot patterns formed in inner surface 32 of leg assembly 16 are shown at 40, 42. All of the slot patterns are substantially identical in construction, and reference is made to FIGS. 2 and 3 for a description of slot pattern 34, with the understanding that such description applies with equal force to the remaining slot patterns formed in the inner and outer surfaces of leg assemblies 16, 18.

Slot pattern 34 is formed in a recess defined in front surface 28 of leg assembly 18 by a pair of side walls 40, 42 and an end wall 44 extending therebetween. A series cf elongated openings or slots 46 are formed in end wall 44, and slots 46 are spaced an equal distance from each other. With this arrangement, slots 46 are recessed inwardly from outer surface 28 of leg assembly 18.

Slot patterns 34 and 38 are formed in a front tube 47 (FIG. 2) within which front leg 24 of leg assembly 18 is received. Tube 47 is constructed according to conventional sheet metal stamping and forming technology. A rear tubular member, formed similarly to front tubular member 47, receives rear leg 26, and a filler member is placed between the front and rear tubular members. A top cap 48 is placed above the front and rear tubular members and the filler member, which are mounted such as by welding or the like to a base member 50.

Figure 2:
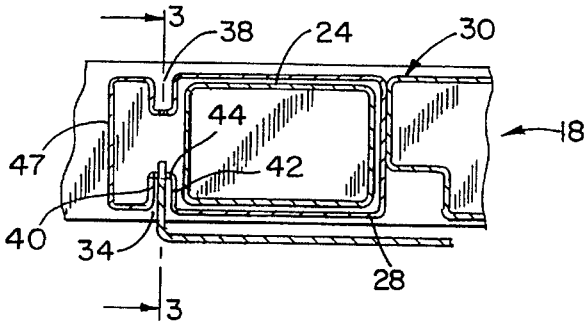
FIG. 2 is a partial section view taken generally along line 2—2 of FIG. 1, showing the manner in which the bracket member engages the slot pattern formed in the worktable leg.
Figure 3:
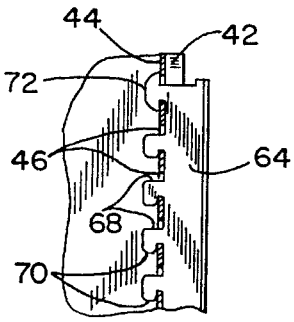
FIG. 3 is a partial sectional view taken along line 3—3 of FIG. 2.

The slot patterns, such as slot pattern 34 described in FIGS. 2–3, extend substantially the entire height of leg assembly 18 between upper cap member 48 and lower base member 50.

The slot patterns in the inner and outer surfaces of leg assemblies 16, 18 are used to mount a variety of components to leg assemblies 16, 18. FIG. 1 illustrates a work surface extension assembly 52 adapted for mounting to outer surface 28 of leg assembly 18. Work surface extension assembly 52 includes a work surface extension 54 secured by a suitable bracket or the like to a vertical channel-shaped support member 56, which in turn is adjustably mounted to a horizontal channel-shaped base member 58. Vertical support member 56 includes a longitudinally extending vertical slot 60, and a manually operable tightening screw 62 extends into a threaded opening formed in base member 58 for clamping vertical support member 56 to base member 58 in a desired vertical position according to user requirements.

A pair of brackets 64, 66 are mounted to the ends of horizontal base member 58. Brackets 64, 66 are spaced apart a distance equal to that of the center-to-center spacing of slot patterns 34, 36, enabling brackets 64, 66 to be engaged with slot patterns 34, 36 to adjustably and removably mount work surface extension assembly 52 to leg assembly 18. Brackets 64, 66 include a series of fingers 68 having tabs 70 extending downwardly therefrom. Brackets 64, 66 further include an upper locking tab 72 defining a semicircular shape. Base member 58 is engaged with slot patterns 34, 36 with vertical support member 56 and work surface 54 removed therefrom, by first engaging locking tab 72 within a desired one of slots 46, with base member 58 being oriented in a substantially horizontal plane. Base member 58 is then pivoted downwardly such that the lower end of upper locking tab 72 rides on the lower edge of the slot 46 within which locking tab 72 is inserted, and fingers 70 and tabs 68 are inserted through the slots 46 below the slot within which locking tab 72 is received. Once base member 58 is in a substantially vertical plane, base member 58 is moved downwardly to engage the undersides of fingers 68 with the lower edge of each slot 46, with depending fingers 70 engaging the inner surface of end wall 44 below each slot 46. This functions to lock base member 58 to leg assembly 18. Work surface extension 54 and support member 56 are then assembled to base member 58 by use of screw 62, which allows work surface 54 to be moved to a desired vertical position relative to leg assembly 18. The connection of base member 58 to leg assembly 18 can be adjusted by reversing the above steps to disengage base member 58 from leg assembly 18, placing base member 58 in a different desired position, and carrying out the steps noted above to re-engage base member 58 with leg assembly 18.

Figure 4:
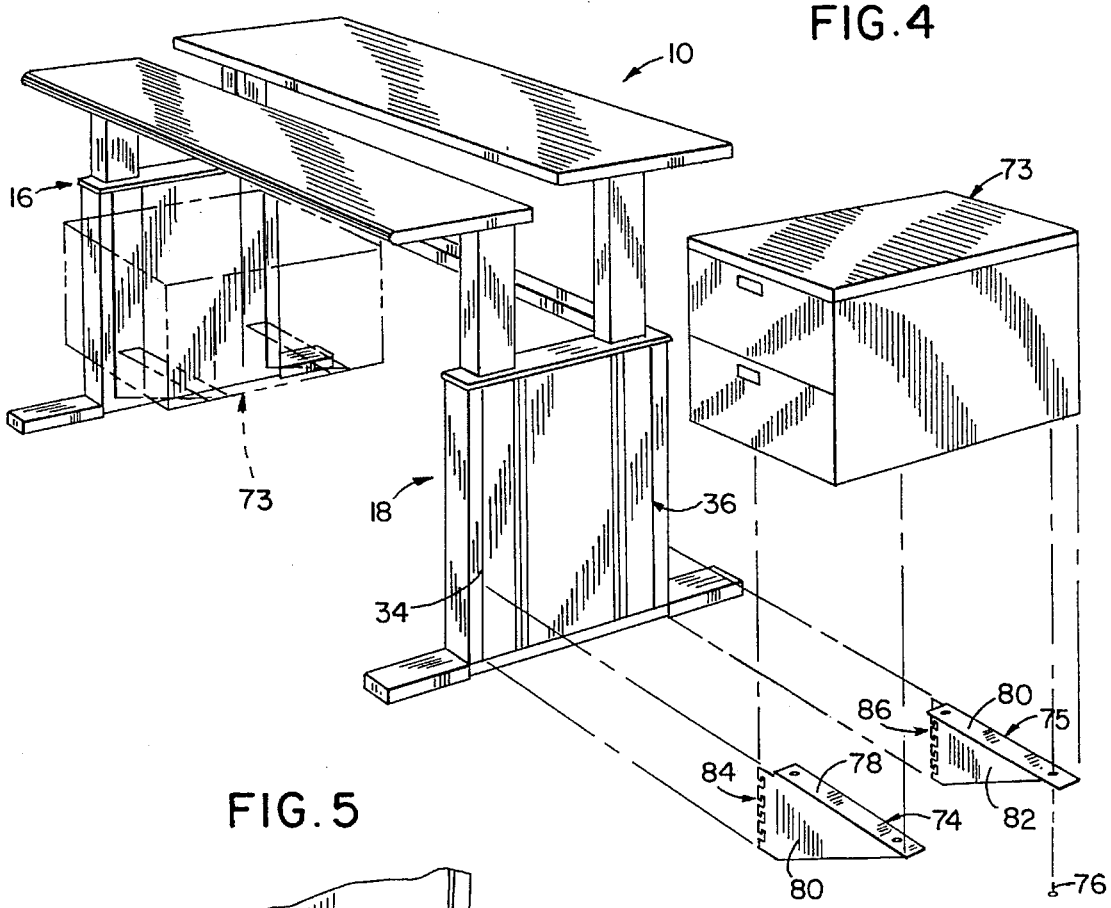
FIG. 4 is a view similar to FIG. 1, showing a system for mounting a file cabinet or pedestal to the worktable leg.

FIG. 4 illustrates worktable 10 and mounting of a file cabinet assembly 73 thereto using a pair of brackets 74, 75. File cabinet assembly 73 is of conventional construction, including a box defining upper, lower, rear and side walls, and a pair of drawers mounted for sliding inward-outward movement relative thereto. Brackets 74, 75 are mounted to the bottom wall of file cabinet 73, by means of a series of screws 76 interconnecting upper horizontal connector portions 78, 80 of brackets 74, 75, respectively with the bottom wall of file cabinet 73. Brackets 74, 75 further include sides 80, 82, respectively which include connector structure, shown generally at 84, 86, respectively, which is substantially identical in construction to fingers 68 and tabs 70 as described in connection with base member 58 (FIGS. 1, 3). Brackets 74, 75 are spaced apart a distance equal to the center-to-center distance of slot patterns 34, 36, and are engageable with slots 46 at any desired vertical position of slot patterns 34, 36 to mount file cabinet 73 to leg assembly 18. In this instance, however, connector structure 84 does not include a locking tab such as 72, since brackets 74, 75 are permanently affixed to file cabinet 73.

As shown in phantom in FIG. 4, file cabinet 73 may also be mounted to inner surface 32 of leg assembly 16 using slot patterns 40, 42. Similarly, file cabinet 70 could be mounted to the inner surface of leg assembly 18 or the outer surface of leg assembly 16, with brackets 74, 75 being mounted to file cabinet 73 180° from their position as shown in FIG. 4 in order to enable the doors of file cabinet assembly 73 to face forwardly.

Figure 5:
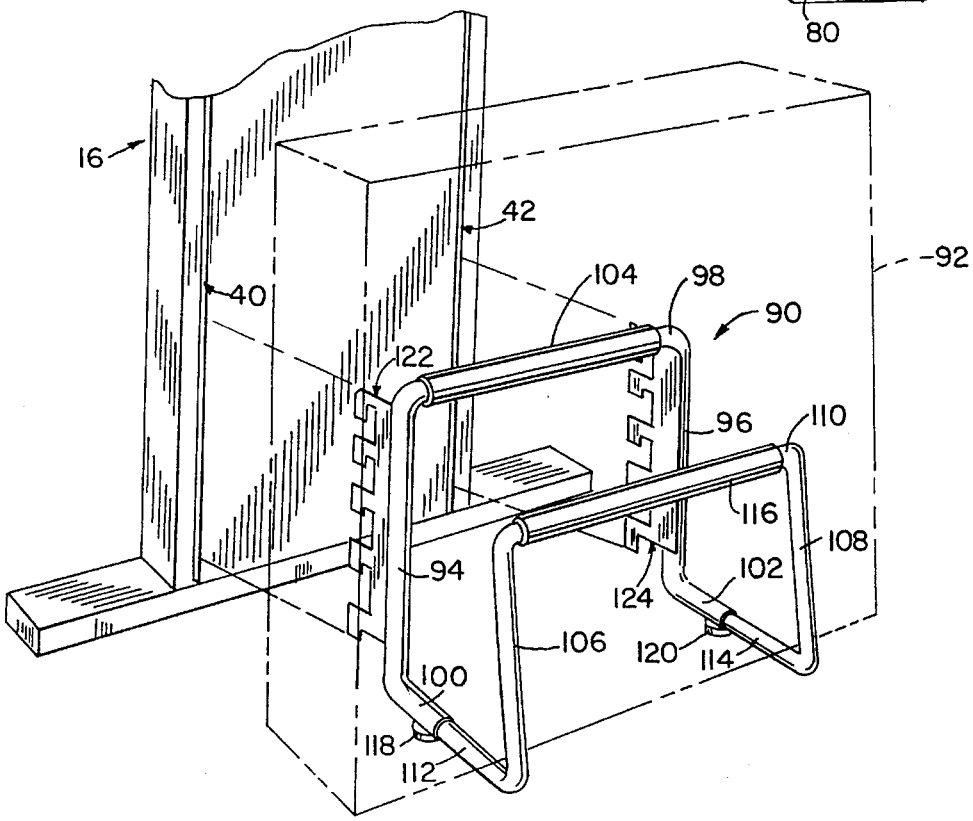
FIG. 5 is a partial isometric view showing a computer unit holder adapted for mounting to one of the surfaces of one of the worktable legs.

FIG. 5 illustrates a computer unit holder assembly 90 for engaging and supporting a computer unit, shown in phantom at 92. Holder assembly 90 is mountable to the inner or outer surface of either leg assembly 16 or leg assembly 18 for storing computer unit 92 in a location accessible to worktable 10 and above the floor.

Holder assembly 90 includes a tubular inner frame defined by a pair of spaced vertical members 94, 96, an upper horizontal cross-member 98 extending therebetween, and a pair of lower horizontal members 100, 102 extending outwardly from the lower ends of vertical members 94, 96. A resilient sleeve or pad 104 is mounted to upper cross-member 98. A tubular second frame includes a pair of angled members 106, 108 having a horizontal upper cross-member 110 extending therebetween, and a pair of lower members 112, 114 extending outwardly therefrom. A resilient sleeve or pad 116 is mounted to upper cross-member 110. Lower members 112, 114 of the second frame are received within lower tubular members 100, 102 of the first frame for telescoping sliding inward/outward movement, and manually operable tightening screws 118,120 extend through threaded openings formed in lower members 100, 102 to selectively fix the position of the second frame relative to the first frame. In this manner, the distance between upper cross-members 98, 110 is adjusted according to the width of computer unit 92. This enables upper members 98, 110 and their resilient pads 104, 116, respectively to engage the computer unit sides, with the lower edge of computer unit 92 being supported by members 100, 102 and 112, 114.

A pair of brackets 122, 124 are mounted to vertical members 94, 96, respectively of the first frame of computer holder 90. Brackets 122, 124 are again spaced apart a distance equal to the center-to-center spacing of slot patterns 40, 42, and include spaced apart fingers and tabs similar to those illustrated and described with respect to FIGS. 1 and 3. Brackets 122, 124 are engageable with the slots of slot patterns 40, 42 at any desired vertical position, in the manner described above, in order to secure holder assembly 90 to leg assembly 16. In this manner, computer unit 92 is securely stored in an out of the way location relative to worktable 10, and is kept off the floor to prevent it from being bumped or kicked by the user of worktable 10.

Alternatively, it is understood that holder assembly 90 could be mounted to the slot patterns in the outer surface of leg assembly 16 or to the slot patterns in the inner or outer surfaces of leg assembly 18, as desired by the user.

Figure 6:
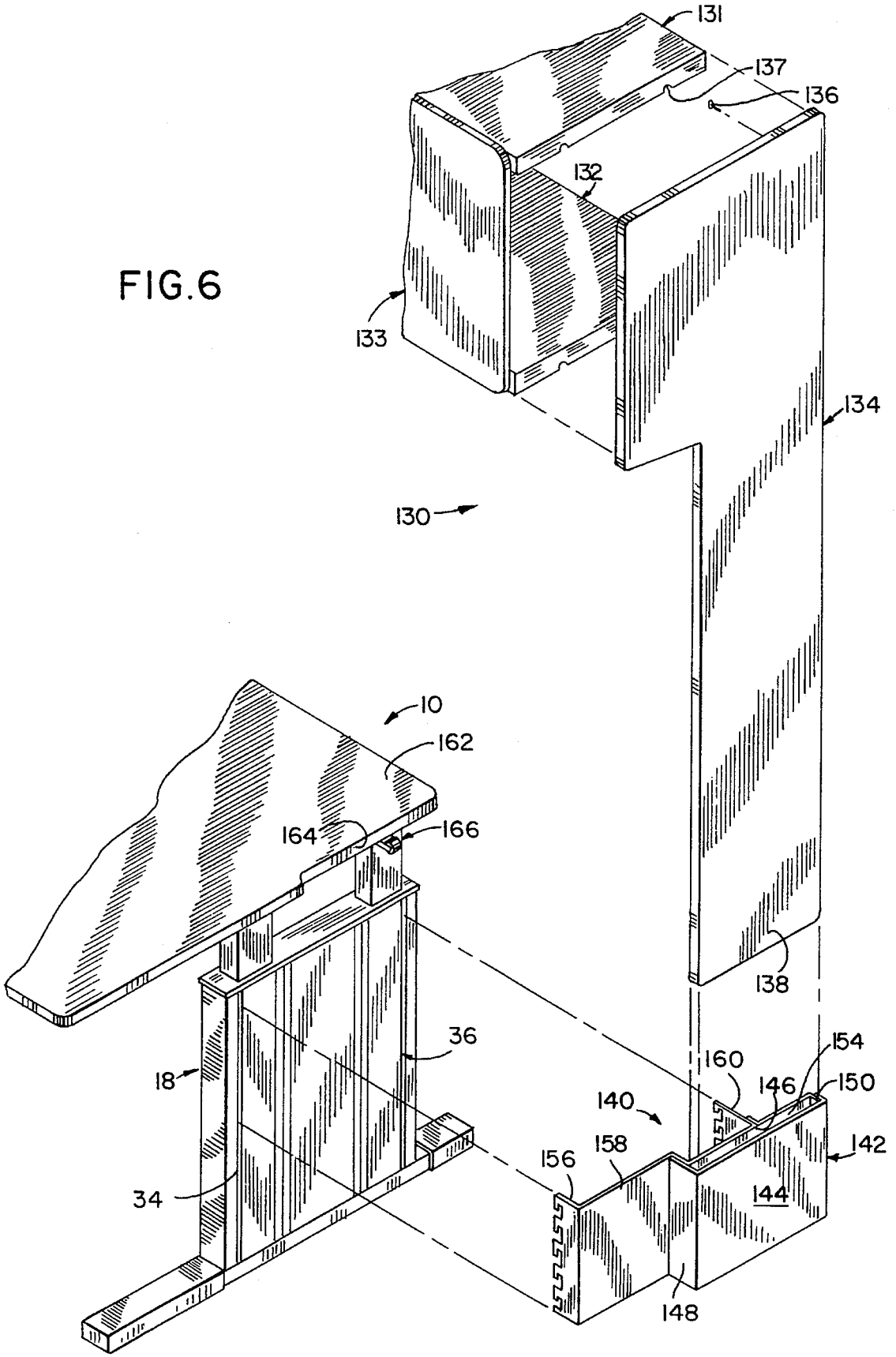
FIG. 6 is a partial isometric view showing a portion of an overhead storage unit adapted for mounting to the worktable legs.
Figure 7:
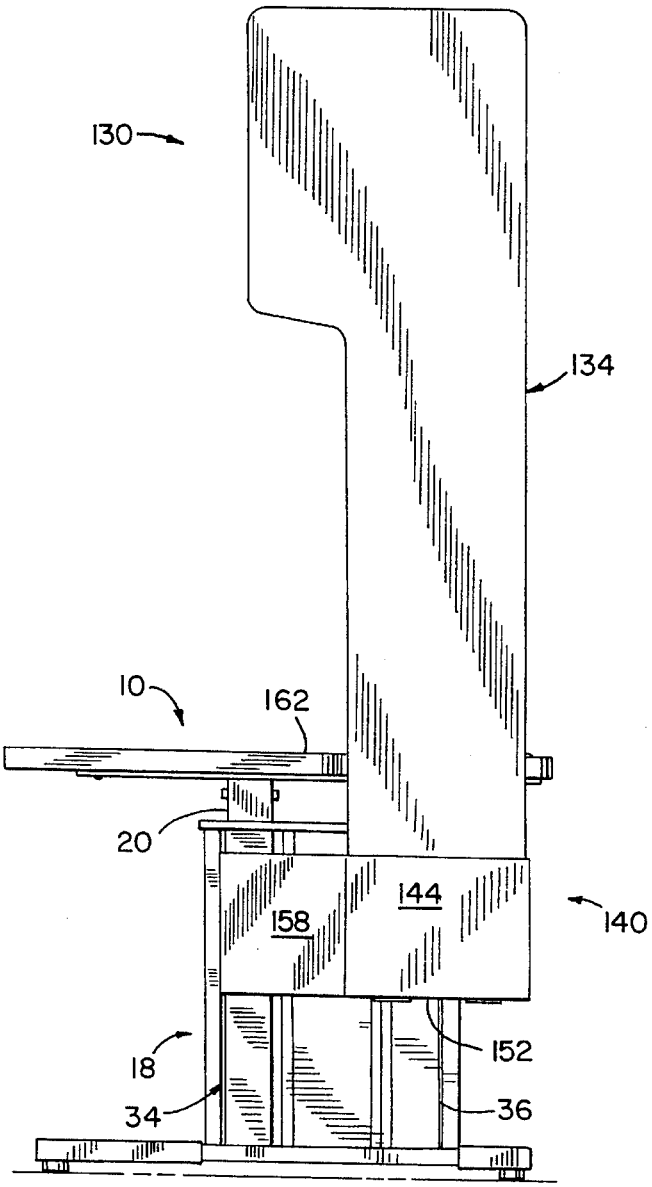
FIG. 7 is a side elevation view of the overhead storage unit of FIG. 6 as mounted to the table legs.
Figure 8:
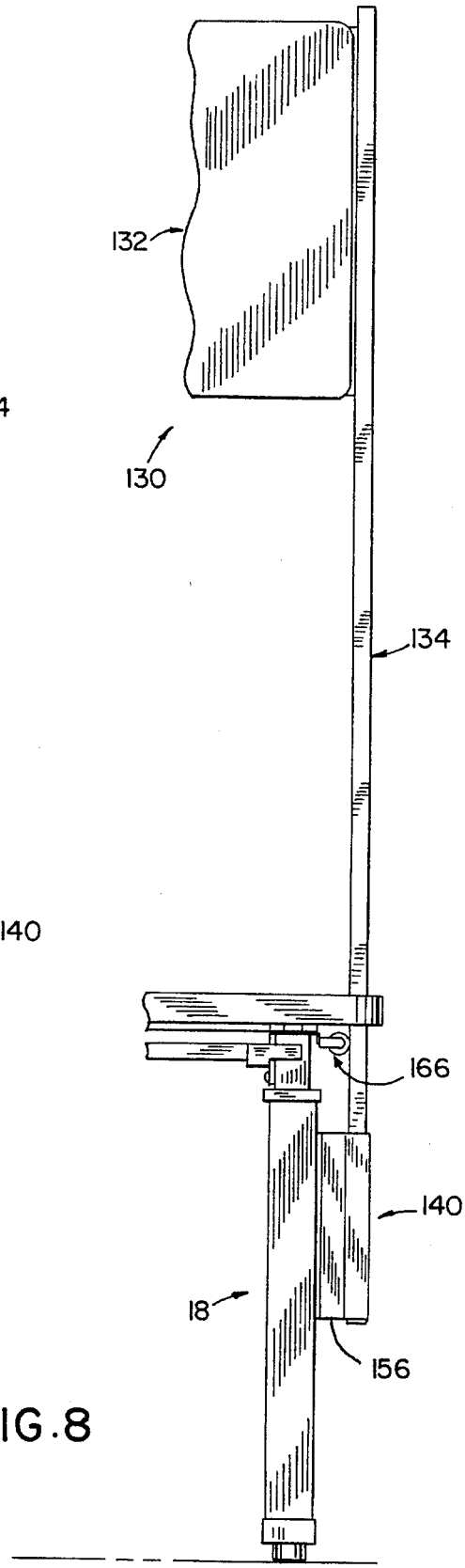
FIG. 8 is a partial front elevation view showing mounting of the overhead storage unit to the table leg.

FIGS. 6–8 illustrate an overhead storage assembly 130 adapted for mounting to worktable 10. Overhead storage assembly 130 includes a pair of shelves 131, 132 to which a conventional flipper door 133 is mounted. Shelves 131, 132 are mounted to a pair of side panels, one of which is shown at 134, by means of a series of screws 136 or the like connected to side panels 134 onto which notches, such as 137, formed in shelves 131, 132 are placed. Shelves 131, 132 and door 133 thus form an overhead storage bin. Alternatively, shelves 131, 132 could be used without door 133 to provide overhead shelf space.

Side panel 134 terminates in a lower end portion 138, and is adapted to be received within a bracket assembly 140 which is engageable with slot patterns 34, 36 in leg assembly 18.

Bracket assembly 140 includes a pocket-defining base 142 including an outer wall 144, an inner wall 146, and a pair of side walls 148, 150. A bottom wall 152 (FIG. 7) interconnects the lower ends of walls 144–150, so that base 142 defines a passage or pocket 154 within which lower portion 138 of side panel 134 is received. Bracket assembly 140 further includes a bracket 156 extending from a plate 158, which in turn is interconnected with side wall 148 and rear wall 146 of base 142. A bracket 160 extends rearwardly from rear wall 146. Brackets 156, 160 are spaced apart a distance equal to the center-to-center distance of slot patterns 34, 36, and include finger and tab structure similar to that shown and described with respect to FIGS. 1 and 3. In this manner, base 142 is engageable with slot patterns 34, 36 via brackets 156, 160 to mount bracket assembly 140 to leg assembly 18 in a desired vertical position on leg assembly 18.

As shown in FIG. 6, worktable 10 may be provided with a continuous tabletop work surface 162, which includes notches, such as 164, at the rearward end of its sides to receive side panels 134. Rollers, such as 166, are mounted below work surface 162 extending into the notches, such as 164, for engaging side panels 134 and supporting overhead storage unit 130 during adjustment of the height of work surface 162. Additionally, rollers 166 provide lateral stability to overhead storage unit 130 when mounted to table 10.

It is understood that a bracket assembly similar to that as shown at 140 is mounted to leg assembly 16 for receiving and supporting a side panel on the opposite end of overhead storage unit 130, which is a mirror-image of side panel 134. A similar notch and roller system, such as shown at 164, 166, are provided on tabletop 162 at the opposite end of work surface 162.

Any number of components may be assembled to the inner and outer surfaces of leg assemblies 16, 18, as desired according to individual user requirements. For example, each surface of each leg assembly could have one or more items connected thereto in order to minimize the footprint of a work space and to efficiently arrange the components contained within the work space.

The invention thus provides a simple and economical system for mounting one or more items to one or more legs of a worktable, in which the position of the items mounted to the worktable leg can be adjusted and in which the item can be interchanged and/or removed as desired according to user requirements.

Various alternatives and embodiments are contemplated as being within the scope of the following claims particularly pointing out and distinctly claiming the subject matter regarded as the invention.

We claim:

1. In a worktable including a work surface supported above a pair of spaced legs, each leg including a first inner surface facing toward the other leg and a second outer surface facing away from the other leg, a system for mounting an item to the worktable, comprising:

a pair of spaced vertical slot patterns provided on at least one of the inner and outer surfaces of each leg;

a pair of bracket members mounted to the item mounted to the worktable, the bracket members being spaced apart a distance substantially equal to the spacing of the slot patterns, each bracket member including structure engaged with one of the slot patterns for removably mounting the item to the worktable leg;

wherein the item comprises an overhead storage unit including an upper storage area and a pair of sides depending therefrom, wherein each side is interconnected with the pair of bracket members for mounting to one of the legs;

wherein each side of the overhead storage unit is interconnected with the pair of bracket members by means of pocket structure to which the bracket members are connected and within which the lower end of each side of the overhead storage unit is received; and a pair of rollers mounted adjacent the work surface and extending outwardly one from each side of the work surface above one of the legs, and wherein each roller is engaged with one of the overhead storage unit sides to stabilize the overhead storage unit during adjustment of the vertical position of the work surface.

2. A method of removably mounting an item to a worktable, the worktable including a work surface and a pair of spaced legs, each leg defining an inner surface facing toward the other leg and an outer surface facing away from the other leg, comprising the steps of:

providing substantially vertical slot structure in at least one of the inner and outer surfaces of each leg;

mounting bracket structure to the item mounted to the worktable, the bracket structure including connector structure removably engageable with the slot structure;

removably engaging the bracket structure with the slot structure to removably secure the item to the leg of the worktable;

wherein the step of mounting bracket structure to the item comprises mounting a bracket structure to each side of an overhead storage unit which defines an upper storage area and a pair of depending sides, and wherein each bracket structure is removably engaged with the slot structure to support the overhead storage unit;

wherein the step of mounting the bracket structure to the overhead storage unit side comprises interconnecting the bracket structure with a pocket assembly defining a passage, and further comprising the step of placing the lower end of each overhead storage unit side into the passage; and engaging a roller with each overhead storage unit side adjacent the work surface for stabilizing the overhead storage unit during adjustment of the height of the work surface relative to the overhead storage unit.

* * * * *